US005134551A

United States Patent [19]

Stelzer

[11] Patent Number: 5,134,551

[45] Date of Patent: Jul. 28, 1992

[54] BAG LAMP FRAME KIT

[76] Inventor: Steven M. Stelzer, 3812 Villanova, Houston, Tex. 77005

[21] Appl. No.: 621,573

[22] Filed: Dec. 3, 1990

[51] Int. Cl.[5] ..... A45C 15/06

[52] U.S. Cl. ..... 362/156; 362/806

[58] Field of Search ..... 362/156, 352, 806

[56] References Cited

U.S. PATENT DOCUMENTS 4,117,533 9/1978 Hagelthorn ..... 362/363 X 4,926,296 5/1990 Blume et al. ..... 362/156

5,034,868 7/1991 Stelfox et al. ..... 362/352

*Primary Examiner*—Allen M. Ostrager

[57] ABSTRACT

A frame kit consisting of a centrally located apparatus from which a plurality of flexible wire members extend. A light bulb socket base and light bulb are attached to the centrally located apparatus. The flexible wire members may be maneuvered and configured to follow the lines of a decorative bag and when power is supplied to the apparatus, a unique lamp is created by illuminating the decorative bag.

18 Claims, 3 Drawing Sheets

BAG LAMP FRAME KIT

BACKGROUND OF THE INVENTION

The present invention relates to lamps. Specifically, the present invention relates to a kit comprising flexible wiring, a standard light socket, a light bulb and an electrical cord; all which may be assembled in a plurality of configurations to form a frame kit for the purpose of illuminating a variety of decorative bags; i.e. shopping bags, specialty bags, gift bags.

A preliminary search produced references for a collapsible lamp-shade structure and for a modular table lamp, but no references were found which Performed the functions of the present invention.

Many specialty shops and retail stores take great pride and go to a considerable expense to develop a particular design or logo for which they wish to have associated with their particular store. One of the most prominent items these designs are placed on are shopping bags. Most retail stores provide shopping bags to their customers as a courtesy for carrying several packages more easily. In developing this identity, retail stores consider colors, designs and a variety of artwork. Some of the shopping bags developed by these shops are true works of art. The present invention allows a unique use for these bags by Providing a means of illuminating the bags and allowing them to become even more aesthetically pleasing.

An object of the present invention is to provide a novel use for decorative bags.

Another object of the present invention is to provide a kit for illuminating those decorative bags.

Yet another object of the present invention is to provide a collapsible structure which may be formed to fit virtually any decorative bag for the purpose of illuminating that bag.

SUMMARY OF THE INVENTION

The present invention Provides a kit for the purpose of illuminating a decorative bag and thus creating a novel and unique lamp. The kit of the Present invention comprises flexible wiring, a lamp socket, electrical wiring and means for assembling said kit.

The kit of the present invention may be packaged flat for distribution and may be assembled by the consumer or the kit may be completely assembled for immediate use by the consumer. The advantage of the kit being assembled by the consumer is that it may be formed or shaped to match the configuration of any decorative bag.

The present invention basically comprises a centrally located apparatus from which a plurality of flexible wire members radiate horizontally; which apparatus may be affixed to a standard light bulb socket. The flexible wire members are preferably encased in plastic and any exposed ends are capped with tip protectors. A UL listed light socket base with an attached electrical cord including an on-line switch and plug may be inserted into the open center of the centrally located apparatus and flexible wire assembly. The opposite end of the electrical cord has a UL listed plug. A light bulb may then be tightened into the light socket; which makes up the entire assembly.

This entire assembly may be lowered into a decorative bag. The flexible wire members may be maneuvered horizontally to conform to the particular size and shape of the decorative bag and positioning the light bulb socket base so that it is slightly elevated above the bottom of the decorative bag. The excess of each flexible wire member (whatever Portion is too long for the bottom of the bag) being bent vertically to help support the sides of the decorative bag.

An incision may be made into the bag at a suitable location near the bottom of the bag to allow for passage of the plug end of the electrical cord. An adhesive backed reinforcement panel is provided to apply over the incision in the bag so it does not continue to tear and area looks finished and neat.

The electrical cord may be inserted into a wall outlet and the on-line switch turned on. The bag will be illuminated.

Note: The light bulb should be positioned in the center of the bag to avoid contact with any portion of the bag.

Another embodiment of the present invention includes the same configuration as above with the addition of a drywall anchor driven into a wall and a support rod attached to the drywall anchor; which support rod may serve as a hanger for the handles of the bag to suspend the decorative bag from the wall.

DETAILED DESCRIPTION OF THE PREFERRED EMBODIMENT

Figure 1A:
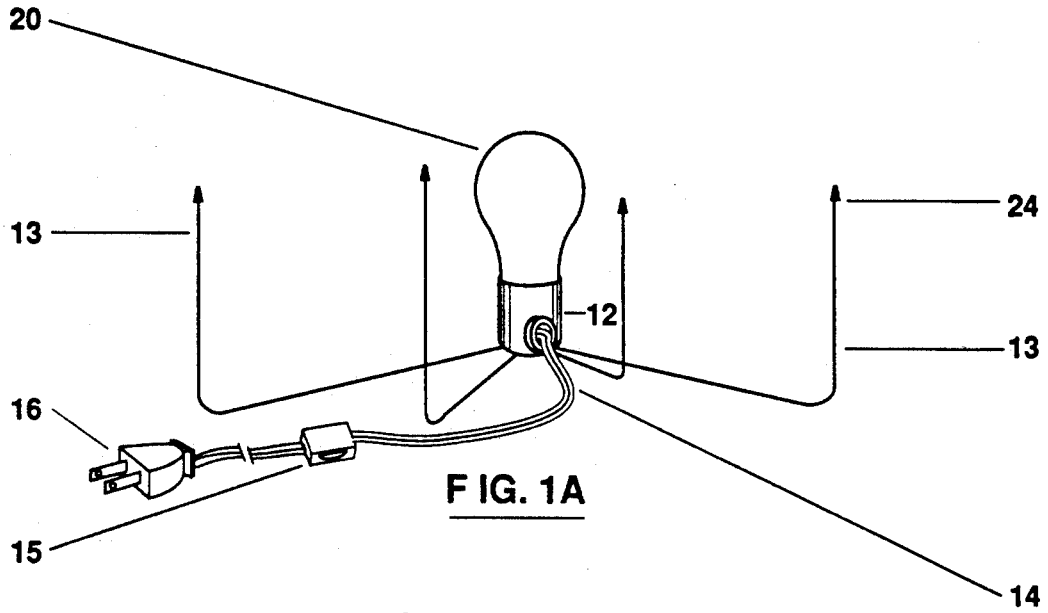
FIG. 1 is a breakaway view of the present invention illustrating the kit assembly and a decorative bag.
Figure 1B:
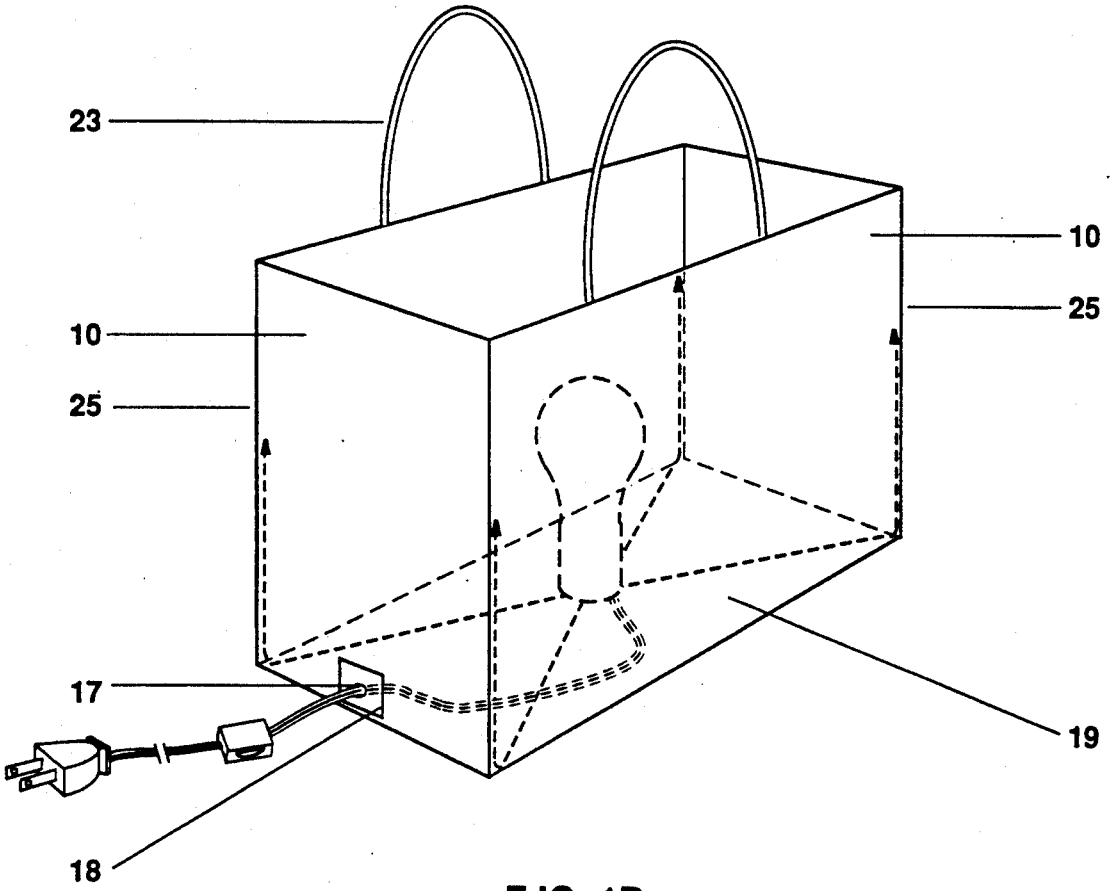
Figure 2:
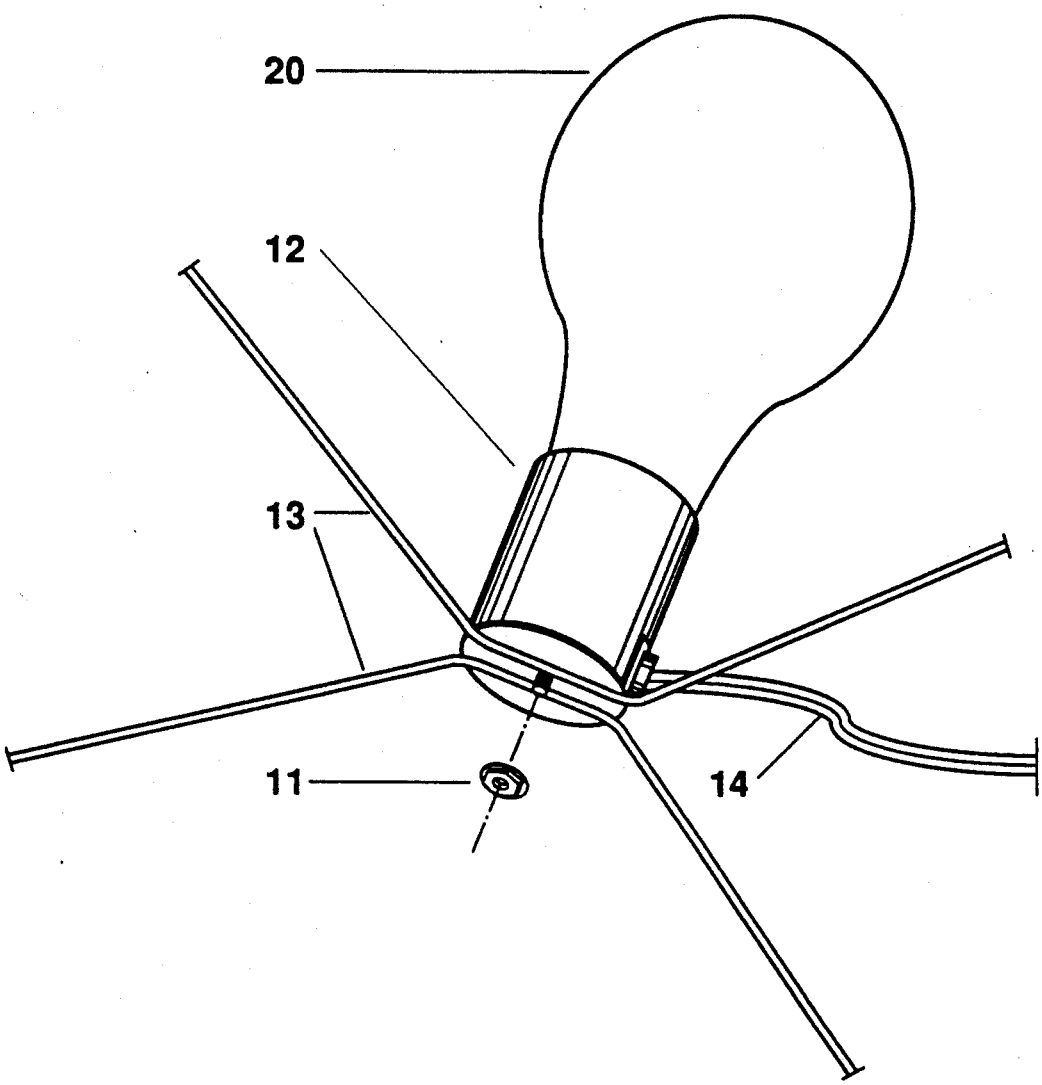
FIG. 2 is a more detailed view of the centrally located apparatus and flexible wire assembly of the present invention.

Referring to FIG. 1, a decorative bag which consists of a rectangular base 19 and vertical walls 10 extending upwardly from the base 19. Each of the vertical walls 10 has vertical corners 25 formed therebetween. A pair of handles 23 are fastened to opposing vertical walls 10 and extending outwardly therefrom. The bag has a generally rectangular configuration. The bag in an open position which may be Placed on a table or any other secure surface. Placed along the rectangular base 19 of the decorative bag is a centrally located apparatus 11 from which a plurality if flexible wire members 13 radiate outwardly horizontally; each flexible wire members 13 being symmetrical to the other flexible wire members 13. This apparatus 11 may be attached to a standard size light socket base 12. Each of the flexible wire members 13 may be Plastic coated and capped with tip protectors 24.

Positioned transversely into the open center of the centrally located apparatus 11 is a standard UL listed light bulb socket base 12. An electrical cord 14 exits from the light bulb socket base 12. The electrical cord 14 includes an on-line switch 15 which one-line switch 15 is located conveniently along the electrical cord 14. The opposite end of the electrical cord 14 includes a UL listed Plug 16 for insertion into a wall outlet.

The entire assembly as described may be lowered into a decorative bag with the light bulb socket base 12 positioned approximately in the center of the decorative bag and elevating the light bulb socket base 12 slightly above the base 19 of the decorative bag which can be accomplished by bending the flexible wire members 13 to accommodate the desired Position. The flexible wire members 13 which radiate outwardly horizontally from the centrally located apparatus 11 may then be maneuvered to conform to the shape of the decorative bag which can be accomplished by extending each flexible wire member 13 to a corresponding vertical corner 25 of the decorative bag. The excess length of the flexible wire members 13 which are too long for the base 19 of the decorative bag may be turned or bent vertically to match the lines of the decorative bag and the excess length may also serve to reinforce the stability of the vertical walls 10 of the decorative bag.

An incision 17 may be made into the lower side of the decorative bag 10 through which the electrical cord 14 and plug 16 may pass. The incision 17 may be reinforced with an adhesive backed reinforcement 18, preferably in plastic, which reinforcement 18 may reduce tearing of decorative bag. A light bulb 20 may be screwed into the light bulb socket base 12.

Upon inserting the plug 16 into a wall outlet and switching on the on-line switch 15 located on the electrical cord 14, the bulb 20 will illuminate the inside of the decorative bag and will produce an attractive and aesthetic light and piece of art.

Figure 3:
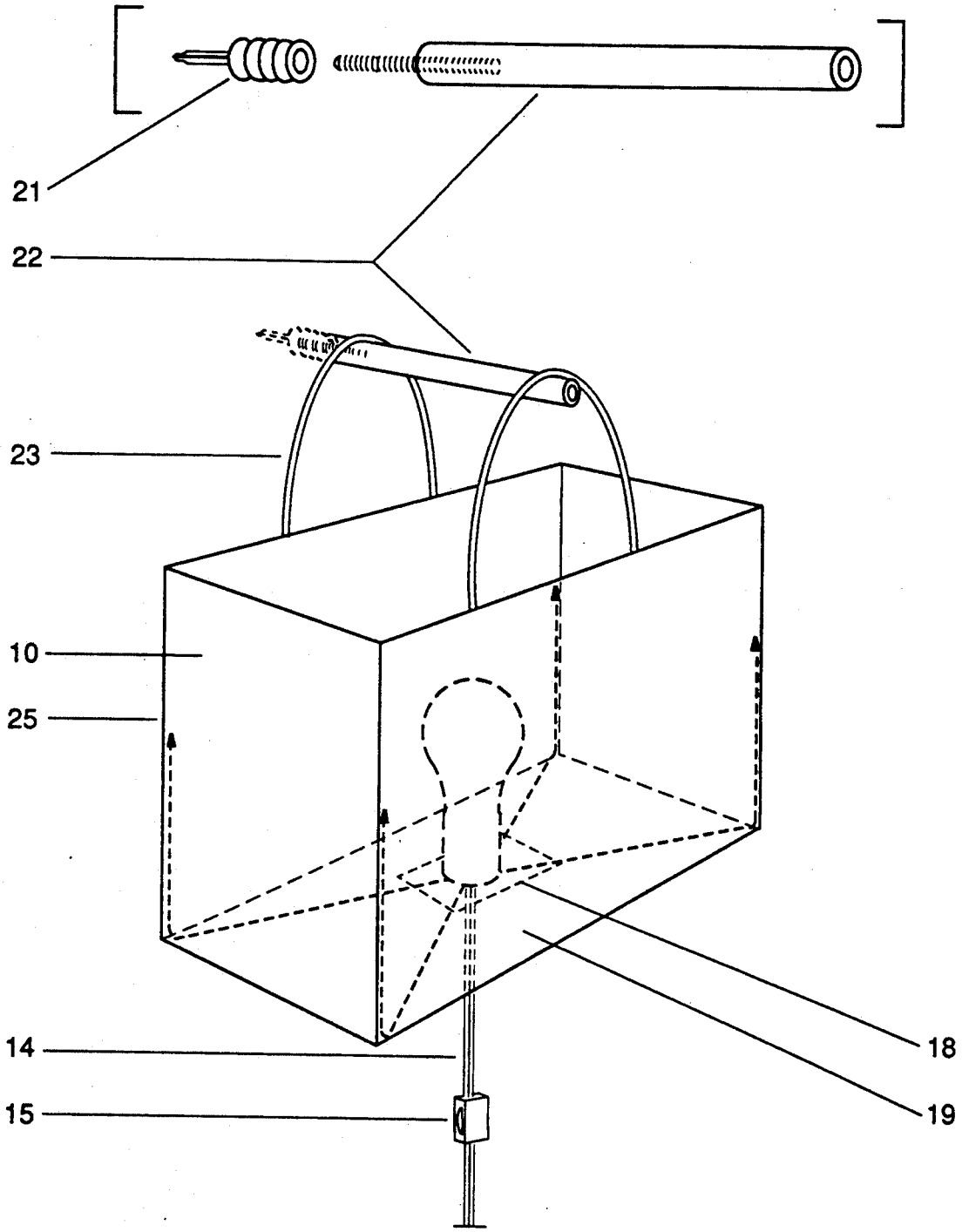
FIG. 3 illustrates the Present invention and decorative bag being used in combination with a drywall anchor and support rod to support decorative bag.

Referring to FIG. 3 the above described assembly remaining the same and further including a drywall anchor 21 which may be driven into a wall at a suitable picture hanging height. Above further comprising a support rod 22 which may be secured to the drywall anchor 21 and left to extend transversely to the wall. Said support rod 22 being of sufficient length to allow the suspending and hanging of the handles 23 of a decorative bag. This embodiment may be used to transform the table top illuminated decorative bag into a wall hanging illuminated decorative bag.

The foregoing description of the invention has been directed to a particular preferred embodiment of the present invention for purposes of explanation and illustration. It will be apparent to those skilled in the art that many modifications and changes in the bag lamp frame kit may be made without departing from the scope and spirit of the invention. It is therefore intended that the following claims cover such modifications and claims.

I claim:

1. An apparatus comprising:

socket means for receiving a light bulb;

a first flexible member connected to a bottom surface of said socket means, said first flexible member extending horizontally radially outwardly from said socket means;

a second flexible member connected to said bottom surface of said socket means, said second flexible member extending horizontally radially outwardly from said socket means, said second flexible member angularly offset from said first flexible member;

an electrical line electrically connected to said socket means and extending outwardly therefrom and a bag generally surrounding said socket means and said first and second flexible members, said first and second members extending across and abutting a bottom surface of said bag.

2. The apparatus of claim 1, said first flexible member having a first end Positioned on one side of said socket means, said first flexible member having another end Positioned on an opposite side of said socket means from said first end.

3. The apparatus of claim 2, said second flexible member having a first end Positioned on one side of said socket means, said second flexible member having another end Positioned on an opposite side of said socket means from said first end.

4. The apparatus of claim 1, said first and second flexible members arranged symmetrically relative to each other.

5. The apparatus of claim 1, said first and second flexible members having a Plastic coated exterior.

6. The apparatus of claim 3, said ends of said first and second flexible members having a tip Protector fastened thereon.

7. The apparatus of claim 1, said socket means having a fastener threadedly attached thereto, said fastener for removably fastening said first and second flexible members to said socket means.

8. The apparatus of claim 1, said bag having a rectangular shape, said bag having a plurality of vertical corners, said first and second flexible members having end portions extending upwardly adjacent to said vertical corners.

9. The apparatus of claim 1, said bag having an incision formed through a surface of said bag, said electrical line extending through said incision.

10. The apparatus of claim 9, further comprising:

a reinforced panel overlying said incision so as to resist tearing of said bag along said incision.

11. The apparatus of claim 1, further comprising:

an anchor suitable for attachment to a vertical surface; and a support rod connected to said anchor and extending outwardly therefrom, said support rod receiving a portion of said bag so as to suspend said bag

12. An apparatus comprising:

a bag;

a light socket positioned within said bag;

a light bulb threadedly fastened to said light socket, said light bulb extending upwardly from said light socket interior of said bag;

support means fastened to a bottom surface of said light socket for supporting said light socket and said light bulb upwardly within said bag, said support means comprising:

a first flexible member connected to a bottom surface of said light socket, said first flexible member extending horizontally radially outwardly from said light socket; and a second flexible member connected to said bottom surface of said light socket, said second flexible member extending horizontally radially outwardly from said light socket, said second flexible member being angularly offset from said first flexible member, said first and second flexible members abutting a bottom surface of said bag; and an electrical line electrically connected to said light socket.

13. The apparatus of claim 12, said bag having a rectangular base and vertical walls extending upwardly from said base, each of said vertical walls having a vertical corner formed therebetween.

14. The apparatus of claim 13, said first flexible member extending between a first set of opposing corners of said bag along said rectangular base, said second flexible member extending between a second set of opposing corners of said bag along said rectangular base.

15. The apparatus of claim 14, each of said first and second flexible members having end portions extending vertically upwardly adjacent to said vertical corners of said bag.

16. The apparatus of claim 12, each of said first and second flexible members comprising a Plastic coated wire, said wire having a Protective tip affixed at each end.

17. The apparatus of claim 13, said bag having a pair of handles extending outwardly therefrom, said apparatus further comprising:

an anchor suitable for attachment to a vertical surface; and a support rod connected to said anchor and extending outwardly therefrom, said support rod for receiving a portion of said bag so as to suspend said bag.

18. The apparatus of claim 12, said bag having an incision in a surface, said electrical line extending through said incision, said apparatus further comprising:

a reinforcing panel overlying said incision of said bag for resisting tearing of said bag along said incision.

* * * * *